US007248142B2

(12) United States Patent
Beck et al.

(10) Patent No.: US 7,248,142 B2
(45) Date of Patent: Jul. 24, 2007

(54) THIN DEFLECTABLE RESISTOR

(75) Inventors: David B. Beck, West Jordan, UT (US); John A. Sindt, Sandy, UT (US); Thomas E. Danielson, Sandy, UT (US)

(73) Assignee: Sensitron, Inc., Draper, UT (US)

( * ) Notice: Subject to any disclaimer, the term of this patent is extended or adjusted under 35 U.S.C. 154(b) by 66 days.

(21) Appl. No.: 11/195,881

(22) Filed: Aug. 2, 2005

(65) Prior Publication Data

US 2007/0030112 A1 Feb. 8, 2007

(51) Int. Cl.
*H01C 3/06* (2006.01)
*H01C 7/00* (2006.01)

(52) U.S. Cl. ..... 338/211; 338/114; 338/154

(58) Field of Classification Search ..... 338/210–212, 338/114–115, 154
See application file for complete search history.

(56) References Cited

U.S. PATENT DOCUMENTS 4,654,475 A * 3/1987 Jackson et al. ..... 174/94 R
5,086,785 A 2/1992 Gentile et al.
5,157,372 A 10/1992 Langford
5,309,135 A 5/1994 Langford
5,576,684 A 11/1996 Langford
5,583,476 A 12/1996 Langford
5,629,073 A * 5/1997 Lovell ..... 428/206
5,990,799 A * 11/1999 Boon et al. ..... 340/667
6,111,234 A * 8/2000 Batliwalla et al. ..... 219/549

* cited by examiner

*Primary Examiner*—Kyung Lee
(74) *Attorney, Agent, or Firm*—Holme Roberts & Owen LLP

(57) ABSTRACT

A system and method for a deflectable resistor. The deflectable resistor has a first layer of conductive material and a second layer of conductive material on a top surface of a substrate, said first layer of conductive material having a resistance that changes predictably. The change of resistance of the first layer of conductive material reflects an amount of deflection of the respective layer. A dielectric is placed over the first and second layers of conductive material. A third layer of conductive material is placed thereon. The dielectric material electrically insulates the first and second layers from the third layer.

35 Claims, 6 Drawing Sheets

THIN DEFLECTABLE RESISTOR

BACKGROUND OF THE INVENTION

1. The Field of the Invention

This invention relates to electrical components and more particularly to deflectable resistors which vary in electrical resistance.

2. The Relevant Technology

Potentiometers are standard elements of electrical and electronic circuits. They are widely in use today for a variety of purposes including the measurement of mechanical movement. U.S. Pat. No. 5,157,372 (Langford) and U.S. Pat. No. 5,583,476 (Langford), (which are incorporated herein for all purposes), presented a new device identified as a flexible potentiometer that provided an electrical resistor having a consistent and predictable variable electrical output upon deflection or bending between configurations.

Flexible potentiometers have been sold commercially and, in some configurations, require two side-by-side connecting conductive runs of material proximate each other forming, in effect, a U-shaped device. Such devices, in turn, require a width that can be regarded as excessive or too large, thereby preventing use in selected applications.

BRIEF SUMMARY OF THE INVENTION

In various exemplary embodiments of the present invention, a deflectable resistor is provided. In general, the deflectable resistor comprises a substrate, a first layer of conductive material, a second layer of conductive material, a layer of dielectric material and a third layer of conductive material disposed on the surface of the dielectric layer. The substrate is formed of a deflectable electrical insulating material having a top surface, a first end, a second end, a width and a length between said first end and said second end. In operation, the substrate bends in at least a first direction that is generally in a negative y-direction relative to a longitudinal x-axis extending along the length of the substrate.

A first layer of conductive material has a first end proximate the first end of said substrate, a second end proximate the second end of said substrate, a width and a length between said first end and the second end is disposed on the top surface of the substrate. The first layer of conductive material has a resistance between the first end and the second end of the first layer of conductive material that changes predictably. The resistance is measured when an electrical signal is applied thereto. In general, the change of resistance of the first layer of conductive material reflects the amount of deflection in the first direction.

A second layer of conductive material is deposited on the surface of the substrate and electrically connected to the first end of the first layer of conductive material. The second layer of conductive material is configured to connect the first end of the first layer of conductive material to external electronic componentry.

A first layer of dielectric material is deposited on the top surface of the substrate and over the first layer of conductive material. The dielectric material provides an electrical insulating barrier between the first and second layers of conductive material and a third layer of conductive material disposed on the first layer of dielectric material.

A third layer of conductive material is deposited on the surface of the first layer of dielectric material. The third layer of conductive material is electrically connected to the second end of said first layer of conductive material. The third layer of electrically conductive material also is configured to connect the second end of the first conductive layer to external electronic componentry.

In operation, the bending of the first layer of conductive material between the first configuration and the second configuration opens and widens a number of cracks in the first layer of conductive material. As the cracks open and widen in the first layer of conductive material, the corresponding resistance of the first layer of conductive material also increases in a predictable and measurable manner. Accordingly, the resistance predictably and measurably increases as the amount of bending to a second configuration increases.

In one embodiment, a second layer of dielectric material is deposited on the top surface of the substrate and over the first layer of conductive material, the second layer of conductive material, the first layer of dielectric material and the third layer of conductive material. The dielectric material provides an additional electrical insulating barrier between the deflectable resistor and the atmosphere.

In another embodiment, the substrate has a length with a longitudinal y-axis running along said length. The first direction of bending is in a negative x direction relative to the longitudinal y-axis.

In another preferred arrangement, the substrate is bendable between a first configuration and a second configuration. A layer of electrically conductive ink is deposited on a surface of the substrate. In a preferred configuration, the length and said width of the layer of electrically conductive ink is less than the length and said width of the substrate. The layer of conductive ink has a resistance measured between the first end and the second end of the layer of electrically conductive ink that changes predictably when an electrical signal is applied thereto. The change of resistance of the layer of conductive ink reflects an amount of deflection between the first configuration and the second configuration.

A layer of dielectric material is disposed on the surface of the substrate that contains the layer of electrically conductive ink. The layer of dielectric material disposed over at least the layer of conductive ink. The layer of dielectric material is configured for providing an electrical insulating barrier between the conductive ink and a layer of conductive material disposed on the surface of said layer of dielectric material that is connected to the second end of said layer of electrically conductive ink.

In a preferred configuration, the layer of conductible material comprises a conductor formed of an electrically conductive material, such as a soft conductive metal. In a more preferred configuration, the conductor is made of made of silver or a silver alloy or a carbon or a carbon compound.

In an alternate arrangement, the deflectable resistor further comprises a first connector means coupled to the second layer of electrically conductive ink for interconnection to external electrical components and a second connector means coupled to the third layer of conductive material for interconnection to external electrical components.

In a preferred arrangement, the third layer of conductive material extends from the second end of the layer of electrically conductive ink along the surface of the layer of dielectric material to the first end of said substrate. In a more preferred arrangement, a conductor formed of an electrically conductive material is disposed on the top surface of the substrate. The conductor is electrically connected to the first end of said layer of electrically conductive ink. The layer of dielectric material is disposed over the first and second conductors, thereby providing an electrical insulating barrier between the first conductor, the second conductor and the third conductor. The layer of conductive material and the conductor are configured to receive said electrical signal.

In another embodiment, the deflectable resistor desirably includes a segmented conductor. The segmented conductor is positioned on the first layer of electrically conductive ink and is formed of an electrically conductive material deposited on the first layer of electrically conductive ink in spaced apart segments. In a more preferred embodiment, the segmented conductor has a plurality of segments each having a width substantially the width of the layer of the electrically conductive ink and a length selected to regulate the resistance of the first layer of electrically conductive ink.

In another preferred configuration, the first configuration of a substrate is a static configuration. Preferably, the static condition of the substrate may be a substantially flat substrate or one where said substrate has at least one bend.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DESCRIPTION OF A PREFERRED EMBODIMENT

Figure 1:
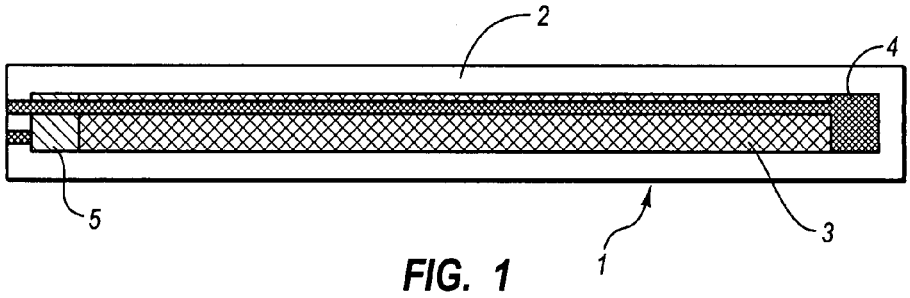
FIG. 1 illustrates a top view of a deflectable resistor in accordance with the present invention.
Figure 1A:
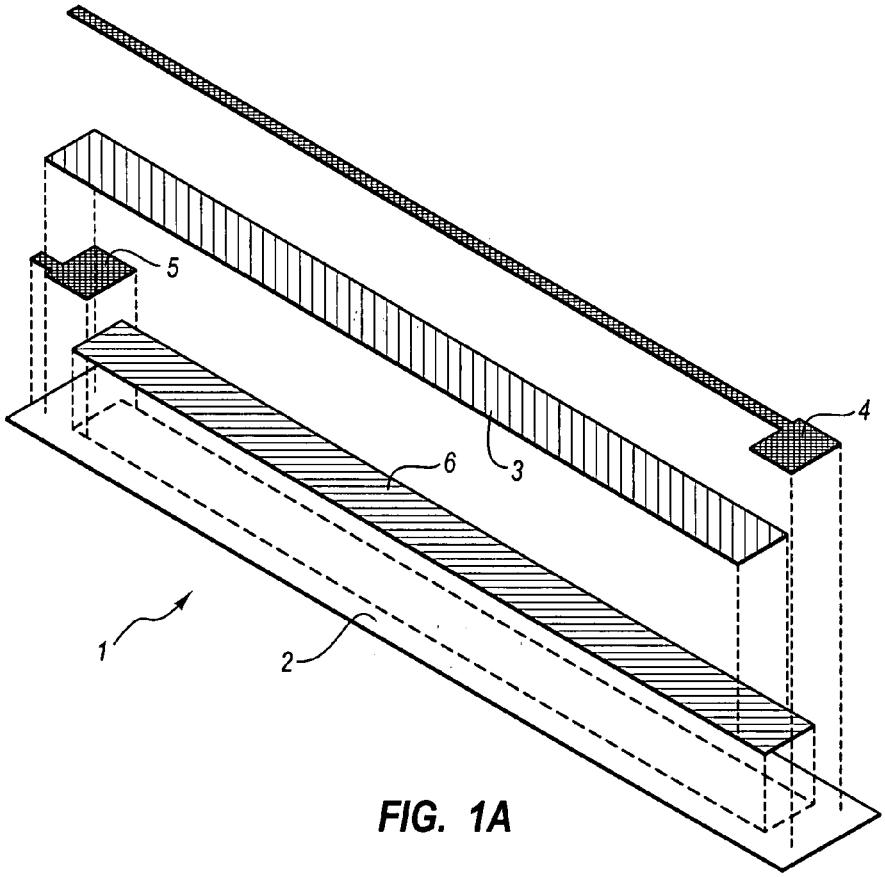

FIGS. 1 and 1A illustrate a top view and an exploded top perspective view respectively of a preferred embodiment of deflectable resistor 1. Deflectable resistor 1 generally comprises a substrate 2, a layer of variable resistance or conductible material 6, first conductor 5, second conductor 4 and a layer of dielectric material 3. On a first manufacturing pass, the layer of variable resistance material 6 is laid down onto the surface of the substrate 2. On a second manufacturing pass, the first conductor 5 is laid on top of, and electrically connected to, one end of the conductible material 6.

During a third manufacturing pass, the dielectric layer 3 is positioned over the variable resistance material 6 and a portion of the first conductor 5, leaving a portion of the variable resistance material 6 exposed on the end opposite the first conductor 5. The fourth and possible final manufacturing pass places the second conductor 4 over the exposed portion of the variable resistance material 6 and runs along the surface of dielectric layer 3. The dielectric layer 3 electrically separates the second conductor 4 from both the variable resistance material 6 and the first conductor 5. In an embodiment, a second layer of dielectric material (not shown) is positioned over the variable resistance material 6, the first conductor 5, the second conductor 4, and the first dielectric layer 3. The second layer of dielectric material insulates the deflectable resistor 1 from the atmosphere.

Figure 2:
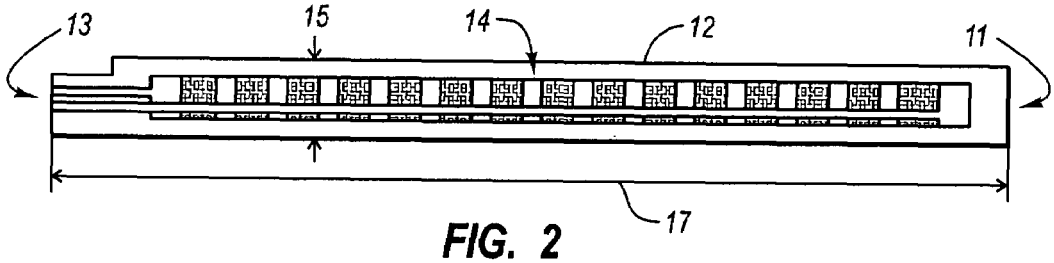
FIG. 2 illustrates a top perspective view of the deflectable resistor depicted in FIG. 1.

FIG. 2 illustrates a top view of another embodiment of deflectable resistor 10. Deflectable resistor 10 generally comprises a substrate 12 having both a top surface and a bottom surface and a layer of conductible material 14 disposed on one of the surfaces. The substrate 12 has a first end 11, a second end 13, a length 17 that extends between the first end 11 and the second end 13 and a width 15. In the illustrated embodiment, the layer of variable resistance or conductible material 14 is disposed on the top surface of the substrate 12 of the deflectable resistor 10.

Substrate 12 is formed of a deflectable insulating material. Various types of materials are presently believed to be suitable as the substrate. The substrate may be constructed of various materials including various polymers, such as polyamide, polyimide (Kapton), and polyester (Mylar), which may be thermoplastics. For applications involving multiple bending movements, certain polyimides have been found to be particularly suitable. However, other materials may be suitable in selected applications. For example, the deflectable resistor may be used to measure inelastic deformation so that the substrate itself is in elastically deformable. Preferably, the substrate 12 should be deflectable without causing an electrical discontinuity or open circuit in the conductor means while generally maintaining its electrical insulating characteristics.

The conductible material 14, also referred to herein as a conductor means, may be a two-part epoxy material, a thermoset adhesive, or a thermoplastic, all incorporating conductive material such as graphite or carbon. The variable resistance material may include a carbon ruthenium. To attach to a substrate, the conductible material 14 may include a material which facilitates wetting, gluing, or sticking. The conductible material 14 may include graphite in combination with a binder. The conductible material 14 is preferably of the type which is applied to the substrate in liquid form and which in turn dries to a solid form.

Merely examples, the substrate 12 may be from about 0.005 to about 0.010 inches in thickness (although various other thicknesses may be acceptable); the variable resistive material 14 may be from about 0.0003 to about 0.001 inches in thickness (although various other thicknesses may be acceptable).

Deflectable resistor 10 may be used to measure a degree or angle of deflection. The greater the amount of the deflection, the greater the resistance of conductible material 14. With measurements, a relationship between the degree or angle of deflection of substrate 12 and the resistance of conductible material 14 can be developed and used in software, that is relatively simple to create.

Figure 3:
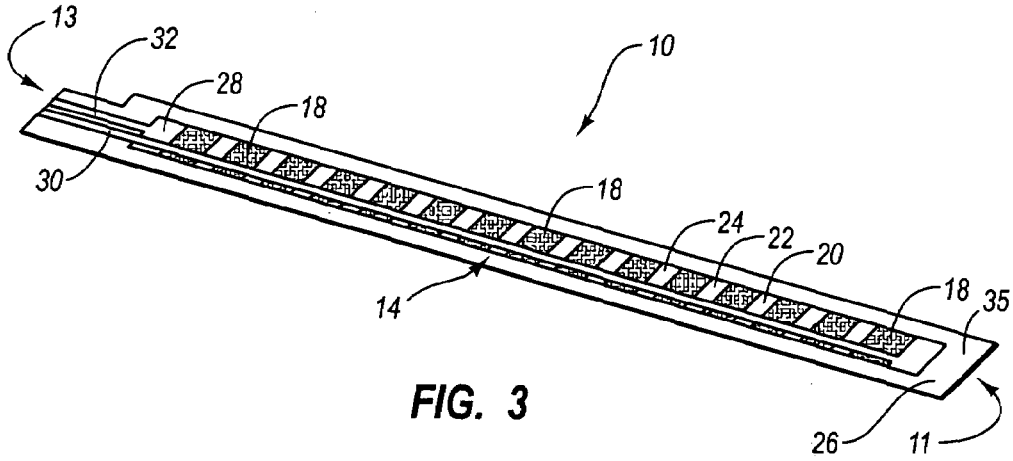
FIG. 3 illustrates an exploded view the substrate, the first layer of conductive material, the first segmented conductor, the dielectric layer and the second segmented conductor.

FIG. 3 illustrates a top perspective view of deflectable resistor 10 in accordance with one aspect of the present invention. The top of deflectable resistor comprises a first top layer of electrically conductive ink 18 disposed on the top surface of substrate 12. The first layer of electrically conductive ink 18 has a first end 19, a second end 21, a length extending from said first end 19 to said second end 21 and a width 23. The first end 19 of the layer of electrically conductive ink 18 is proximate the first end 11 of substrate 12. The second end 21 of the conductive ink layer 18 is proximate the second end 13 of substrate 12. In the illustrated embodiment, the length and width 23 of the electrically conductive ink layer 18 are both less than the length 17 and the width 15 of substrate 12.

The first top layer of electrically conductive ink 18 has a segmented conductor layer disposed thereon. In the illustrated embodiment, the segmented conductor layer of conductive layer 14 comprises a number of segmented conductors 20, 22, 24 and end segmented conductors 26, 28.

Segmented constant resistance conductive material, although not necessary, may be used in combination with deflectable resistor 10 to reduce the resistance and help linearize changes in resistance. The segmented conductors may be made of silver, silver alloys, or other conductive metals, as well as conductive carbon-based compounds. The segmented conductors may be applied in a liquid form, or applied in a solid form which is pressed onto the variable resistance material. The conductivity of the segmented conductors remains essentially constant upon deflection. Therefore, the segmented conductors provide paths for electrical current that are in parallel with the path provided by the variable resistance material 14. The segmented conductors act as attenuators.

The variable resistance material 14 may be spray painted, rolled, silk screened, or otherwise printed onto the substrate. The variable resistance material may be a solid which is pressed onto the substrate. A conductive substrate may be used. The substrate may be connected to a particular potential, such as ground. A non-conductive coating may be applied to the substrate.

It should be appreciated that while the illustrated embodiment shown in FIGS. 1 and 2 depicts a substrate with a layer of conductive material on the top surface of the first length, any number of lengths may be used. For example, deflective resistor 1, 10 may comprise multiple legs having multiple layers of conductive material disposed on the top surface. In this manner, deflective resistor 1, 10 may have two or more lengths, each having a layer of conductive material disposed thereon, with each of the layers of conductive material joined together by a run of conductive material.

Figure 3A:
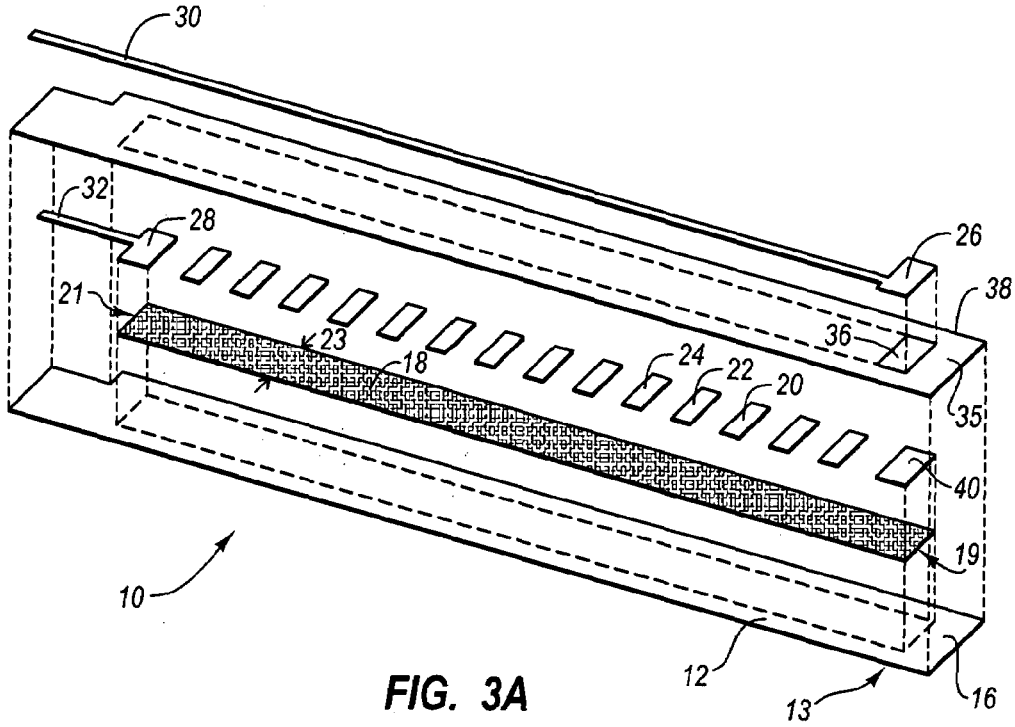

FIG. 3A illustrates an exploded view of a portion of the deflectable resistor 10. As illustrated, a portion of the first layer of conductive material 18 that is disposed on the top surface 16 is illustrated as suspended above the substrate 12. The first segmented conductor having segments 20, 22, 24, end segment 28 and conductive material run or conductor 32 is shown suspended above the layer of conductive material 18. A layer of dielectric material 38 is and is illustrated as suspended above the first layer of conductive material 18 as well as segments 20, 22, 24, end segment 28 and conductor 32. The layer of dielectric material 38

The layer of dielectric 38 is preferably part number 5018 manufactured by DuPont. In alternative arrangements, Acheson Electrodag Uv1015 works equally as well. In the illustrated embodiment, the dielectric material layer 38 is shown as mirroring the size and shape of substrate 12. As one skilled in the art will appreciate, the dielectric layer 38 may be sized small enough to sufficiently cover the conductive material 18 as well as segments 20, 22, 24, end segment 28 and first conductor 32. The dielectric material layer 38 forms an electrical insulating barrier between the conductive material and any conductive material that may be disposed on the surface 35 of the dielectric material layer 38.

In the illustrated example, the dielectric material layer 38 has an aperture 36 cut into one end of the layer proximate the second end 19 of the layer of conductive material 18. The aperture 36 allows for an electrical connection between end segment 40 and end connection 26 of second conductor 30. The second conductor extends along the surface 35 of the dielectric material layer 38 from the end segment 40 to the end of the dielectric material layer 38, which, in the illustrated example, aligns with the first end 13 of the substrate 12. In operation, the resistance of conductive material 18 is measured between first conductor 32 and second conductor 30 by applying an electrical signal thereto.

Figure 4:
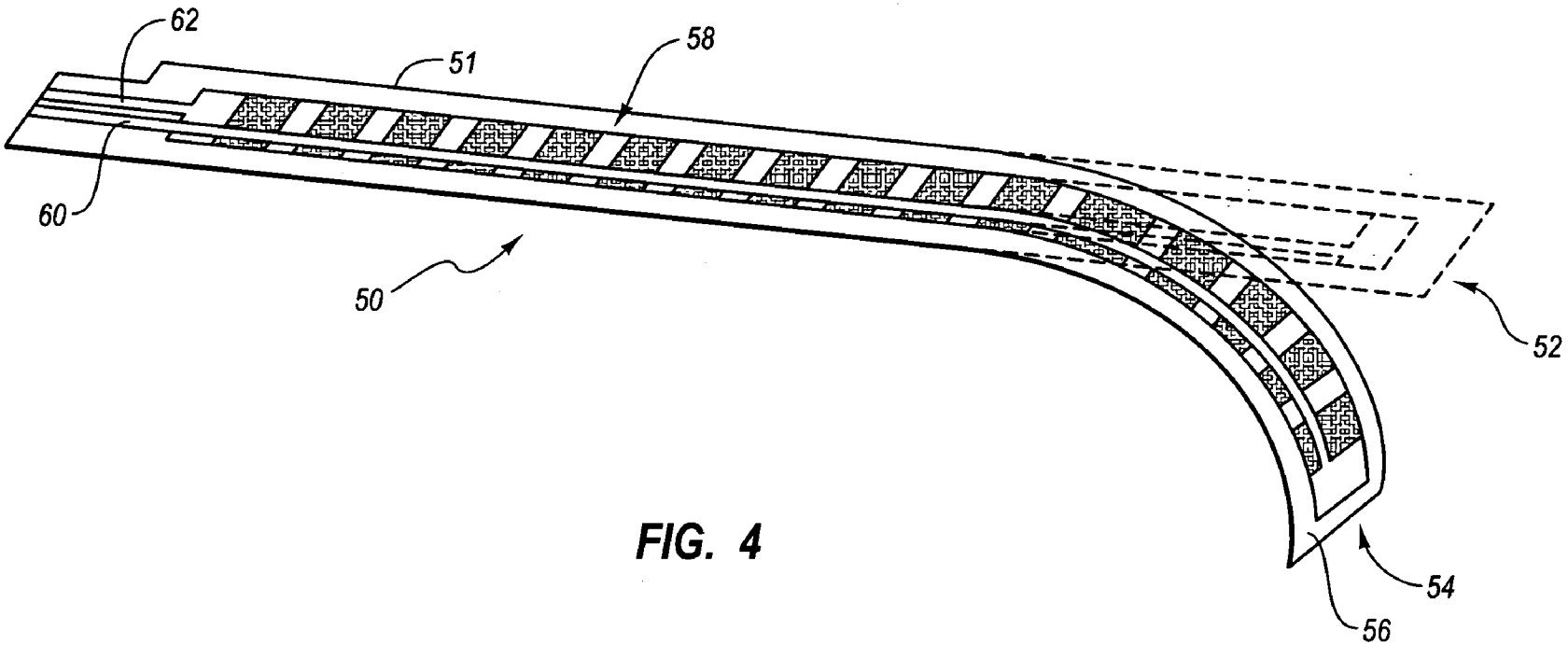
FIG. 4 illustrates a top perspective view of a deflectable resistor deflected in a first direction.

Referring now to FIG. 4, a deflectable resistor 50 is shown having a substrate length 51 in a static position 52 and deflecting in a first direction 54. Substrate length 51 has a first top layer of conductive material 58 disposed on the top surface 56. In operation, when substrate length 51 deflects from a static configuration 52 in the first direction to second configuration 54, the resistance of the first top layer of conductive material 58 predictably changes. The measurement of the change of resistance of the first top layer of conductive material 58 reflects the amount of deflection. This operation will be described in greater detail hereinafter.

Continuing with the operation of deflectable resistor 50, micro-cracks (not shown) are added to the variable resistance material during the manufacturing process. It is believed but not known that as a deflectable resistor (of some or all compositions), is deflected or bent, the distance between the micro-cracks of the variable resistance material separates or widens. That is, in some or all compositions, dried variable resistance material has micro-cracks in a granular or crystalline-type structure which widens and separates upon deflection. As the variable resistance material deflects, the number of cracks and the space between them is believed to increase, thereby changing the electrical resistance in a predictable manner. When the resistor 50 is bent, the change in resistance between the first configuration 52 and the second configuration 54 can be measured upon application of suitable electrical signals to first conductor 60 and second conductor 62.

Figure 5:
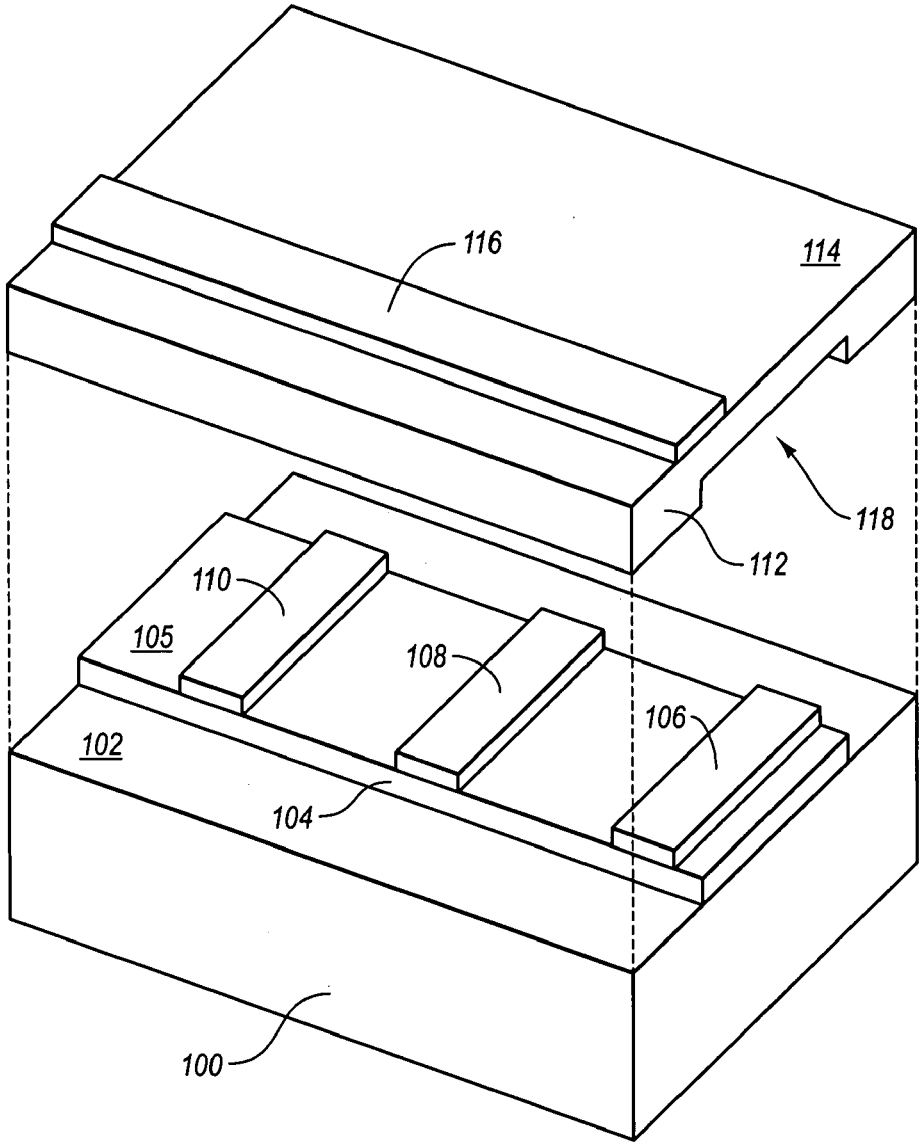
FIG. 5 illustrates an enlarged perspective view of a portion of the top of a deflectable resistor of the present invention.

The top view of a portion of a deflectable resistor of FIG. 5 is shown in perspective and substantially enlarged view. Conductor means 104 is adhered to the top surface 102 of substrate 100. The deflectable resistor includes a segmented conductor adhered to the conductor means 104. The segmented conductor is formed of an electrically conductive material in segments 106, 108, 110 each spaced from the other along the surface 105 of the conductor means 104. A dielectric layer 112 is shown suspended above the substrate 100 and the elements disposed on the surface 102. A layer of conductive material 116 is adhered to the top surface 114 of dielectric layer 112.

Referring to FIG. 5, the substrate 100 is shown to have a thickness which is here shown substantially disproportionate to the true thickness of the substrate solely to facilitate illustration. That is, for the substrate 100 to be elastically deflectable, it is preferred that its thickness be from about 0.13 mm to about 0.25 mm. If it is to be in elastically deflectable, the material and thickness must be appropriately selected.

The conductor means 104 of FIG. 5 is typically a conductive ink which is adhered to the surface 102 of the substrate 100. By adhere, it is meant that the conductive ink is attached to the substrate because the conductive ink includes a material which facilitates wetting, gluing, or sticking. A conductive ink suitable for the illustrated embodiment is available from Flexpoint Sensor Systems, 106 west 12200 south, Draper, Utah 84020 and identified as part number 365 or DOH 10. The selected ink includes graphite in combination with a binder.

As illustrated in FIG. 5, the conductive ink 104 is deposited to adhere to the surface 102 of the substrate 100 and in turn has a thickness which is here illustrated substantially larger than the actual thickness. That is, the thickness of the layer of conductive ink 104 is illustrated disproportionate to the actual thickness of the substrate 100 and of the actual layer of the conductive ink 104. In particular the thickness of the conductive ink 104 is from about 0.01 millimeters to 0.02 millimeter and desirably about 0.15 millimeters.

Continuing with FIG. 5, the top surface 105 has a segmented conductor having segmented conductor segments 106, 108, 110 that may be positioned and adhered to the conductor means 104. The segments are each spaced apart a preselected distance as shown in FIG. 5. Notably, the distances may be different (not illustrated); or they may be selected to be substantially the same as shown in FIG. 5, as desired by the user. The segments are positioned on the conductive ink 104 to regulate the conductivity and in turn the electrical resistance of the conductive ink 104 as more specifically discussed hereinafter.

It may also be noted that the segmented conductor is adhered to the conductive ink and in turn has a thickness which is from about 0.01 millimeters to about 0.02 millimeters and preferably about 0.015 millimeters. Each segment 106, 108, 110 has a length selected to regulate the electrical resistivity of the deflective resistor as discussed hereinafter.

Although illustrated as suspended above substrate 100, in operation, the dielectric layer 112 shown in FIG. 5 is adhered to, at least, the surface 102 of the substrate 100. As a result, the underside of the dielectric layer 112 (not illustrated) would substantially form to the shape of the elements disposed on the surface 102 of substrate 100 so as to form an electrical insulating barrier between the elements and any conductive element disposed on the surface 114 of dielectric layer 112. In a similar arrangement, the dielectric is deposited to adhere to the surface 102 of the substrate 100 as well as the surface 105 of the layer of conductive ink 104 and the surfaces of segments 106, 108, 110.

The layer of dielectric 112 in turn has a thickness which is here illustrated substantially larger than the actual thickness. That is, the thickness of the layer of dielectric material 112 is illustrated disproportionate to the actual thickness of the substrate 100 and of the actual layer of the dielectric 112. In particular the thickness of the layer of dielectric material 112 is from about 0.01 millimeters to 0.02 millimeters.

Figure 6:
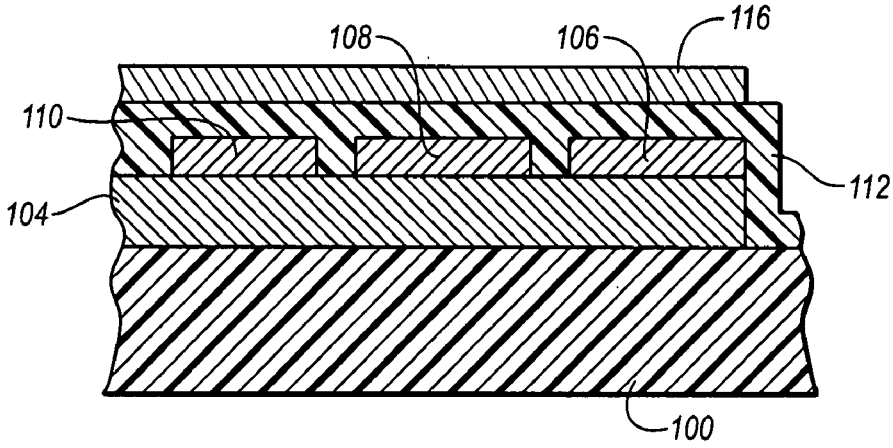
FIG. 6 is a substantially enlarged cross-section view of a portion of a deflectable resistor in a static position.
Figure 7:
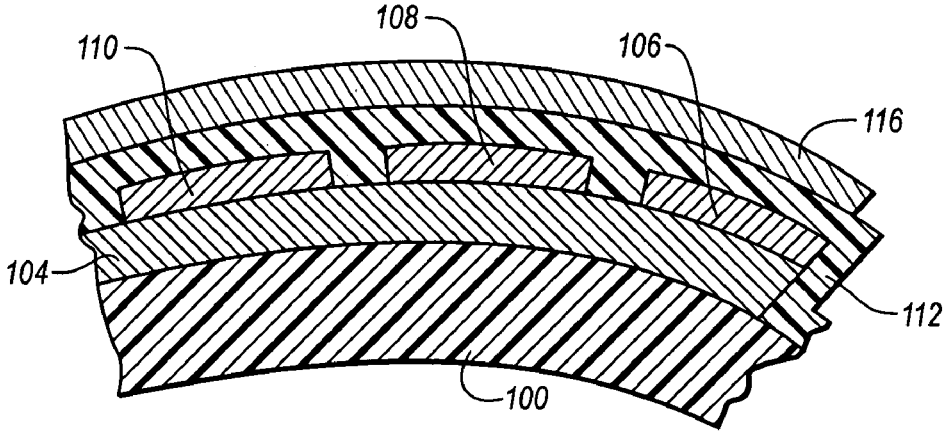
FIG. 7 is a substantially enlarged cross-section view of a portion of a deflectable resistor deflected in a first direction.

In FIGS. 6 and 7, a portion of the deflectable resistor is shown in a first static or non-deflected configuration A (FIG. 6) and a bent configuration B (FIG. 7). The electrical resistance of the deflectable resistor consistently, predictably varies as the substrate 100 is bent or deflected incrementally to any configuration between configuration A and B as well as other configurations involving greater bending or deflection.

The dried conductive ink 104 has a granular or crystalline-type structure which cracks or breaks upon deflection. As the conductive ink 104 bends, the number of cracks and the space between the cracks is believed to increase, thereby changing the electrical resistance in a predictable manner. The change can be measured upon application of suitable electrical signals.

The segmented conductor 106, 108, 110 is positioned along the conductive ink 104 on top surface in pre-selected lengths to control or regulate the resistivity of the deflected conductive ink 104 and in turn ensure that upon repetitive deflections, the variation of the resistance between configurations A and B is consistent throughout the life of the substrate. More particularly, the length and width of the segments 106, 108, 110 as well as the spaces between the segments are empirically selected to ensure a useful resistance range. For example, a sensor is needed that measures 10 cm in length, however, the resting or flat resistance is twice the desired amount. Then, conductors 106, 108 and 110 are configured as such to reduce the surface area of conductive ink, and therefore the resting or flat resistance, by half.

The segmented conductor 106, 108, 110 has been successfully formed of silver. It is also believed formable from conductive silver alloys, and other conductive metals, as well as carbon-based compounds. The segmented conductor 106, 108, 110 retains its electrical conductivity upon deflection.

With the segmented conductor 106, 108, 110 affixed or adhered to the conductor means 104, the resistance may still vary somewhat over time, but the degree of variance is either within acceptable tolerances or otherwise measurable from time to time so that adjustments can be made to accommodate for the drift in resistance over time.

Figure 8:
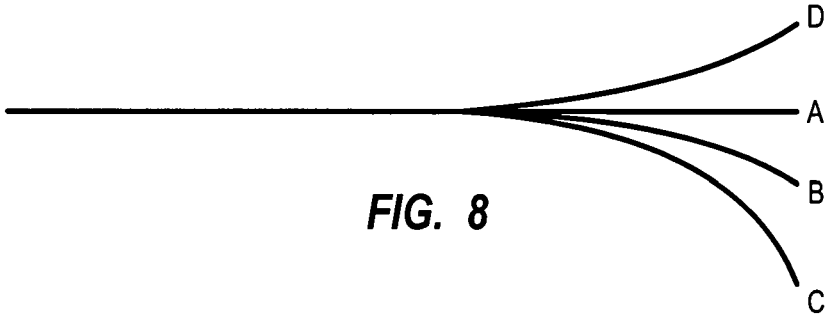
FIG. 8 is a side view of a deflectable resistor in various degrees of deflection.

Deflectable resistor 10 a substantial change in resistance when deflected in a first direction from a straight or static position. For example, FIG. 8 shows a side view of a deflectable resistor 10 at various degrees of deflection, denoted A, B, C and D. Deflectable resistor 10 has a substrate on which at least one layer of variable resistance material is applied on either the top surface or the bottom surface. Degrees of deflection B and C are in a first direction and degree of deflection D is in a second direction.

Generally speaking, position A is a static position that is substantially flat or straight relative to an imaginary x-y axis, where the longitudinal x-axis extends the length of deflectable resistor 10 and the y-axis extends upward and downward relative to the top and bottom surface of deflectable resistor 10. Accordingly, the deflection of deflectable resistor 10 moves in a direction relative to this longitudinal x-axis, and hence the top and bottom surface of deflectable resistor 10, in either a positive y-direction or a negative y-direction. In the illustrated example, deflection degrees B and C are in a negative y-direction and deflection degree D is in a positive y-direction relative to the imaginary longitudinal x-axis extending along the length of the substrate of deflectable resistor 10.

At deflection degree A, which is straight, deflectable resistor 10 has a resistance $R_A$. At deflection degree B, deflectable resistor 10 has a resistance $R_B$, which is substantially greater than resistance $R_A$. At deflection degree B, the level of resistance $R_B$ is predictable and repeatable. At deflection degree C, deflectable resistor 10 has a resistance $R_C$, which is substantially greater than resistance $R_B$ and is predictable and repeatable. Accordingly, as the deflection changes from degree C to degree B, there is a predictable and repeatable decrease in resistance. At deflection degree D, deflectable resistor 10 has a resistance $R_D$, which is insufficiently different than resistance $R_A$. At deflection degree D, since the resistance $R_D$ remains virtually unchanged from $R_A$.

Figure 9:
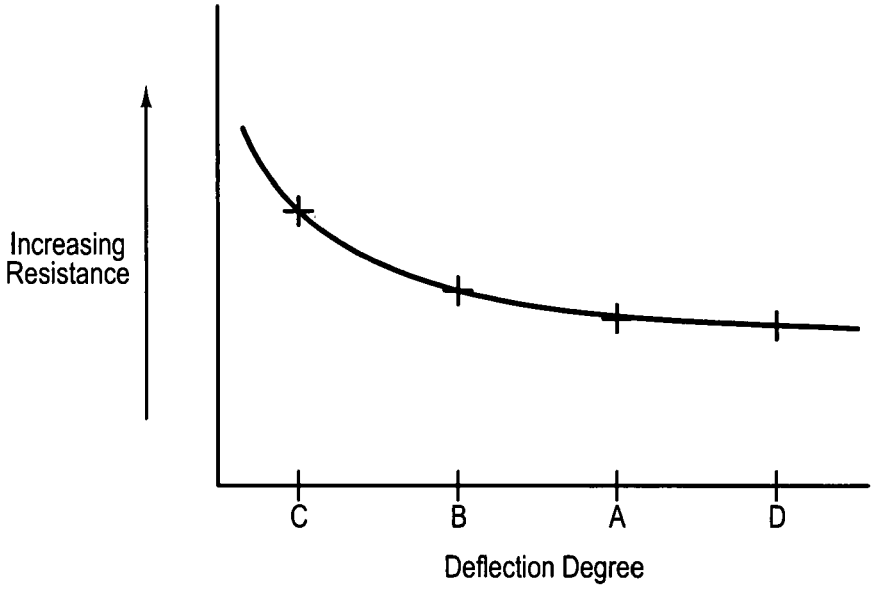
FIG. 9 shows a graph illustrating the correlation between resistance and deflection degrees illustrated in FIG. 8 for a first layer of conductive material on the top surface of deflectable resistor.

FIG. 9 shows a graph illustrating the correlation between resistance and deflection degrees illustrated and explained with respect to FIG. 8 for a first layer of conductive material on the top surface of deflectable resistor 10. At deflection degree C, the resistance of the first layer of conductive material on the top side has increased predictably from static deflection degree A. At deflection degree B, the resistance of the first layer of conductive material on the top side has increased predictably from static deflection degree A to a lesser extent than deflection degree C. At deflection degree D, the resistance of the first layer of conductive material on the top surface is very nearly equal to the resistance of the first layer of conductive material on the top side at the static deflection degree A.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A deflectable resistor comprising:

a substrate formed of a deflectable electrical insulating material having a top surface, a first end, a second end, a width and a length between said first end and said second end, said substrate being bendable in at least a first direction;

a first layer of conductive material having a first end proximate said first end of said substrate, a second end proximate said second end of said substrate, a width and a length between said first end and said second end, said first layer of conductive material disposed on said top surface of said substrate, said first layer of conductive material having a resistance, measured between said first end and said second end of said first layer of conductive material, that changes predictably when bent, said change of resistance of said first layer of conductive material reflects the amount of deflection in said first direction;

a second layer of conductive material formed of an electrically conductive material disposed on said substrate, said second layer of conductive material being electrically connected to said second end of said first layer of conductive material;

a first layer of dielectric material disposed on said top surface of said substrate and over said first layer of conductive material and said second layer of conductive material, said first layer of dielectric material configured for providing an electrical insulating barrier between said first layer of conductive material and a conductive material disposed on said first layer of dielectric material; and a third layer of layer of conductive material formed of an electrically conductive material disposed on said layer of dielectric material, said third layer of conductive material being electrically connected to said first end of said first layer of conductive material.

2. The deflectable resistor of claim 1, wherein said first layer of conductive material comprises an electrically conductive ink.

3. The deflectable resistor of claim 2, wherein said second and third layers of conductive material comprises a soft conductive metal.

4. The deflectable resistor of claim 3, wherein said soft conductive metal comprises a silver or a silver alloy.

5. The deflectable resistor of claim 1, wherein said second layer of conductive material and said third layer of conductive material are configured to receive an electrical signal for measuring said resistance between said first end and said second end of said first layer of conductive material.

6. The deflectable resistor of claim 5 further comprising:

a first connector means coupled to said first layer of layer of conductive material for interconnection to external electrical components; and a second connector means coupled to said second layer of layer of conductive material for interconnection to external electrical components.

7. The deflectable resistor of claim 1, further comprising a second layer of dielectric material disposed over said first layer of layer of conductive material, said second layer of layer of conductive material, said third layer of layer of conductive material and said first layer of dielectric material, wherein said second layer of dielectric material provides an electrical insulating barrier between said first layer of layer of conductive material, said second layer of layer of conductive material, said third layer of layer of conductive material, said first layer of dielectric material and the atmosphere.

8. The deflectable resistor of claim 1, wherein said substrate has a longitudinal x-axis running along said length and wherein said first direction is in a negative y-direction relative to said longitudinal x-axis.

9. The deflectable resistor of claim 8, wherein said longitudinal x-axis occurs when said substrate is in a static position.

10. The deflectable resistor of claim 9, wherein said static position is a substantially flat substrate.

11. The deflectable resistor of claim 1, further comprising a first segmented conductor positioned on said first layer conductive material, said first segmented conductor being formed of an electrically conductive material deposited on said first layer of conductive material in spaced apart segments.

12. The deflectable resistor of claim 11, wherein said first segmented conductor has a plurality of segments each having a width substantially the width of said first layer of conductive material and a length selected to regulate said resistance of said first layer of conductive material.

13. The deflectable resistor of claim 12, wherein said first segmented conductor is made of a soft conductive metal.

14. The deflectable resistor of claim 13, wherein said first segmented conductor is made of silver or a silver alloy.

15. The deflectable resistor of claim 12, wherein said first segmented conductor is made of carbon or a carbon compound.

16. A deflectable resistor comprising:

a substrate formed of a deflectable electrical insulating material having a first end, a second end, a width and a length between said first end and said second end, said substrate being bendable between a first configuration and a second configuration;

a layer of electrically conductive ink having a first end proximate said first end of said substrate, a second end proximate said second end of said substrate, a width and a length between said first end and said second end, said layer of electrically conductive ink disposed on a surface of said substrate, said length and said width of said layer of electrically conductive ink being less than said length and said width of said substrate, said layer of electrically conductive ink having a resistance that changes predictably when bent, said resistance measured between said first end and said second end of said layer of electrically conductive ink, said change of resistance of said layer of electrically conductive ink reflects an amount of deflection between said first configuration and said second configuration;

a first layer of conductive material disposed on the surface of said substrate, said first layer of conductive material electrically connected to said first end of said layer of electrically conductive ink;

a first layer of dielectric material disposed on said surface of said substrate having said layer of electrically conductive ink disposed thereon, said layer of dielectric material disposed over at least said layer of electrically conductive ink, said layer of dielectric material configured for providing an electrical insulating barrier between said layer of electrically conductive ink and conductive material disposed on said layer of dielectric material; and a second layer of conductive material disposed on the surface of said layer of dielectric material, said second layer of conductive material electrically connected to said second end of said layer of electrically conductive ink.

17. The deflectable resistor of claim 16, further comprising a second layer of dielectric material disposed over said layer of electrically conductive ink, said first layer of conductive material, said second layer of layer of conductive material and said first layer of dielectric material, wherein said second layer of dielectric material provides an electrical insulating barrier between said layer of electrically conductive ink, said first layer of conductive material, said second layer of layer of conductive material and said first layer of dielectric material and the atmosphere.

18. The deflectable resistor of claim 17, wherein said conductor is made of a soft conductive metal.

19. The deflectable resistor of claim 18, wherein said conductor is made of made of silver or a silver alloy.

20. The deflectable resistor of claim 17, wherein said conductor is made of carbon or a carbon compound.

21. The deflectable resistor of claim 16, wherein said layer of conductible material comprises a conductor formed of an electrically conductive material.

22. The deflectable resistor of claim 16, wherein said first layer of conductive material and said second layer of conductive material are configured to receive an electrical signal for measuring said resistance between said first end and said second end of said layer of electrically conductive ink.

23. The deflectable resistor of claim 16, wherein said first configuration is a static configuration.

24. The deflectable resistor of claim 23, wherein said static configuration is a substantially flat substrate.

25. The deflectable resistor of claim 23, wherein said static configuration is one where said substrate has at least one bend.

26. The deflectable resistor of claim 16, wherein a bending of said layer of electrically conductive ink between said first configuration and said second configuration causes a plurality of cracks to open in said layer of electrically conductive ink.

27. The deflectable resistor of claim 26, wherein the distance between the cracks in said first layer of electrically conductive ink become wider and the resistance increases as the bending to said first configuration and second configuration increases.

28. The deflectable resistor of claim 16 further comprising:

a first connector means coupled to said first layer of electrically conductive ink for interconnection to external electrical components; and a second connector means coupled to said layer of conductive material for interconnection to external electrical components.

29. The deflectable resistor of claim 16, wherein said first layer of dielectric material is disposed over the entirety of said surface of said substrate having both said layer of electrically conductive ink and said first layer of conductive material disposed thereon.

30. The deflectable resistor of claim 16, wherein said second layer of conductive material extends from said second end of said layer of electrically conductive ink along the surface of said first layer of dielectric material to said first end of said substrate.

31. A deflectable resistor comprising:

a substrate formed of a deflectable electrical insulating material having a top surface, a first end, a second end, a width and a length between said first end and said second end, said substrate being bendable in at least a first direction;

a first layer of conductive material having a first end proximate said first end of said substrate, a second end proximate said second end of said substrate, a width and a length between said first end and said second end, said first layer of conductive material disposed on said top surface of said substrate, said first layer of conductive material having a resistance, measured between said first end and said second end of said first layer of conductive material, that changes predictably when bent, said change of resistance of said first layer of conductive material reflects the amount of deflection in said first direction;

a first layer of dielectric material disposed on said top surface of said substrate and over said first layer of conductive material, said first layer of dielectric material configured for providing an electrical insulating barrier between said first layer of conductive material and a conductive material disposed on said first layer of dielectric material; and a second layer of layer of conductive material formed of an electrically conductive material disposed on said layer of dielectric material, said second layer of conductive material being electrically connected to said first end of said first layer of conductive material.

32. The deflectable resistor of claim 31, further comprising a third layer of conductive material formed of an electrically conductive material disposed on said substrate, said third layer of conductive material being electrically connected to said second end of said first layer of conductive material.

33. A method for varying the resistance in an electrical circuit comprising:

providing a substrate formed of a deflectable electrical insulating material having a top surface, a first end, a second end, a width and a length between said first end and said second end, said substrate being bendable in a first direction;

forming a first layer of conductive material having a first end proximate said first end of said substrate, a second end proximate said second end of said substrate, a width and a length between said first end and said second end, said first layer of conductive material disposed on said top surface of said substrate, said first layer of conductive material having a resistance measured between said first end and said second end of said first layer of conductive material that changes predictably when an electrical signal is applied thereto, said change of resistance of said first layer of conductive material reflects the amount of deflection in said first direction;

forming a second layer of conductive material disposed on the surface of said substrate, said second layer of conductive material being electrically connected to said first end of said first layer of conductive material;

forming a layer of dielectric material disposed on said top surface of said substrate and over said first layer of conductive material and said second layer of electrically conductive material, said layer of dielectric material configured for providing an electrical insulating barrier between said first layer of conductive material, said second layer of conductive material and a conductive material disposed on said layer of dielectric material; and forming a third layer of an electrically conductive material disposed on the surface of said layer of dielectric material, said first conductor being electrically connected to said second end of said first layer of conductive material.

34. The method of claim 33, further comprising:

providing a connector means for connection to external electrical components; and connecting said connector means to said first layer of conductive material and said second layer of conductive material.

35. The method of claim 33, further comprising:

bending said substrate and said first layer of conductive material in said first direction;

applying an electrical signal to said second layer of conductive material and said third layer of conductive material; and measuring a change of resistance between said first end and said second end of said first layer of conductive material to determine an amount of deflection in said first direction.

* * * * *